US005244114A

United States Patent [19]

Traegde

[11] Patent Number: 5,244,114

[45] Date of Patent: Sep. 14, 1993

[54] GOLF BAG DRINK HOLDER APPARATUS AND METHOD

[76] Inventor: Patricia Traegde, 1937 E. Carmen St., Tempe, Ariz. 85283

[21] Appl. No.: 894,466

[22] Filed: Jun. 5, 1992

[51] Int. Cl.[5] ..... A45F 5/00

[52] U.S. Cl. ..... 220/737; 220/481; 206/315.3; 224/148; 224/150

[58] Field of Search ..... 206/315.2, 315.3, 315.5; 224/274, 148, 242, 250, 918, 901; 150/159, 160; 383/2; 220/737, 903, 739, 480, 481, 401, 402; 248/318, 341

[56] References Cited

U.S. PATENT DOCUMENTS

| | | | |
|---|---|---|---|
| 1,208,728 | 12/1916 | Bartlett et al. | 224/148 |
| 1,414,219 | 4/1922 | Simensen | 220/737 |
| 2,494,632 | 1/1950 | Rodin | 224/148 |
| 3,269,683 | 8/1966 | Shinaver | 248/318 |
| 3,460,207 | 8/1969 | Stewart | 150/160 |
| 4,248,366 | 2/1981 | Christiansen | 220/903 |
| 4,449,654 | 5/1984 | Cappis | 224/148 |
| 4,548,375 | 10/1985 | Moss | 224/901 |
| 4,564,957 | 1/1986 | Scharf | 224/148 |
| 4,625,862 | 12/1986 | Clayton | 206/315.3 |
| 4,752,004 | 6/1988 | Very | 206/315.4 |
| 4,802,602 | 2/1989 | Evans et al. | 224/148 |
| 4,838,466 | 6/1989 | Holmstrom | 220/737 |
| 4,924,682 | 5/1990 | Penner | 206/315.3 |
| 4,974,807 | 12/1990 | Moineau | 224/274 |
| 5,105,958 | 4/1992 | Patton | 224/274 |
| 5,131,513 | 7/1992 | Gossage | 383/2 |
| 5,147,079 | 9/1992 | Heather | 220/737 |
| 5,163,591 | 11/1992 | Leiserson et al. | 224/148 |

FOREIGN PATENT DOCUMENTS

| | | | |
|---|---|---|---|
| 27279 | 1/1907 | Austria | 224/148 |
| 753451 | 10/1951 | Fed. Rep. of Germany | 220/737 |

*Primary Examiner*—Allan N. Shoap
*Assistant Examiner*—S. Castellano
*Attorney, Agent, or Firm*—Harry M. Weiss

[57] ABSTRACT

A drink holder apparatus is disclosed which may be connected to a golf bag. This apparatus holds a typical sports bottle and pivots about its connection point on the golf bag to keep the sports bottle in a substantially upright position when the golf bag is tipped and/or transported, thereby avoiding spillage of the drink.

3 Claims, 1 Drawing Sheet

GOLF BAG DRINK HOLDER APPARATUS AND METHOD

FIELD OF THE INVENTION

This invention generally relates to golf apparatus, and more specifically relates to a drink holder apparatus and method for holding a typical plastic sports bottle, which can be attached to a typical golf bag in such a way as to keep the sports bottle in a substantially upright position, even when the golf bag is tipped, carried, or otherwise transported.

DESCRIPTION OF THE PRIOR ART

Golfing is a sport that can take several hours to play. In hot weather it is therefore desirable to take along a cold drink to refresh the golfer's thirst from time to time. Transporting drinks on a motorized golf cart is easy, but is much more difficult when the golfer carries the golf bag or rolls it on a wheeled cart. Most golf bags are not designed or built to accommodate the storage of sports bottles containing drinks. Due to the effort required to carry or roll the golf bag, it is very awkward for the golfer to attempt to carry a sports bottle while transporting the golf bag.

Therefore, there existed a need to provide a golf bag drink holder apparatus and method which is attached to the golf bag, thereby not requiring an additional hand to carry it, which carries a typical sports bottle, and is mounted to the golf bag in such a way as to pivot under the force of gravity to keep the sports bottle in a substantially upright position while transporting the golf bag, thereby avoiding spillage of the drink contained within the sports bottle.

SUMMARY OF THE INVENTION

It is an object of this invention to provide a golf bag drink holder apparatus and method which attaches to a golf bag in such a way as to keep the enclosed sports bottle in a substantially upright position using the natural force of gravity.

It is another object of this invention to provide a golf bag drink holder apparatus and method having a strap to secure the enclosed sports bottle within the holder apparatus.

According to the present invention, a golf bag drink holder apparatus is disclosed. This apparatus is open at the top allowing a typical sports bottle to be placed therein. The apparatus typically has a velcro strap which may be tightened and secured around the sports bottle to secure the sports bottle within the apparatus. The apparatus has attached thereto a strap, loop, or other connection device which attaches to the golf bag in a position such that the drink holder apparatus can swivel or pivot by the force of gravity as the golf bag changes position to keep the enclosed sports bottle in a substantially upright position, thereby avoiding spillage.

The foregoing and other objects, features and advantages will be apparent from the following description of the preferred embodiment of the invention as illustrated in the accompanying drawings.

DESCRIPTION OF THE PREFERRED EMBODIMENT

Figure 1A:
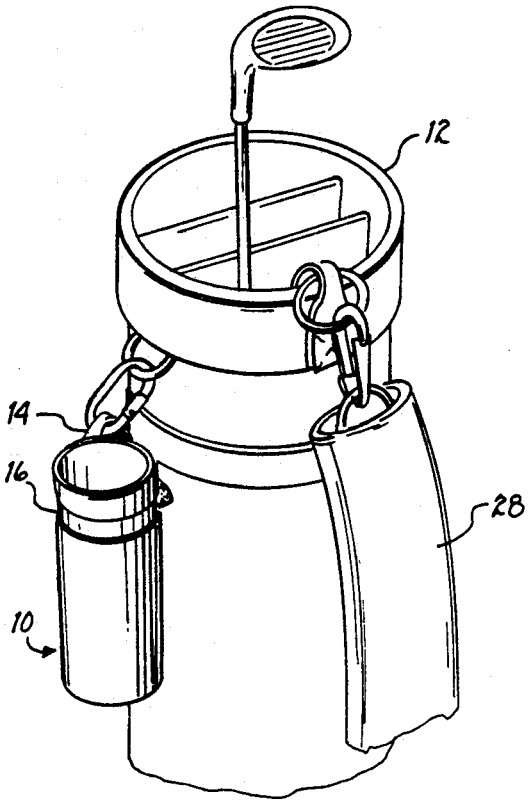
FIG. 1*a* is a perspective view of the golf bag drink holder apparatus of the present invention when used on a golf bag with a carrying strap.
Figure 2:
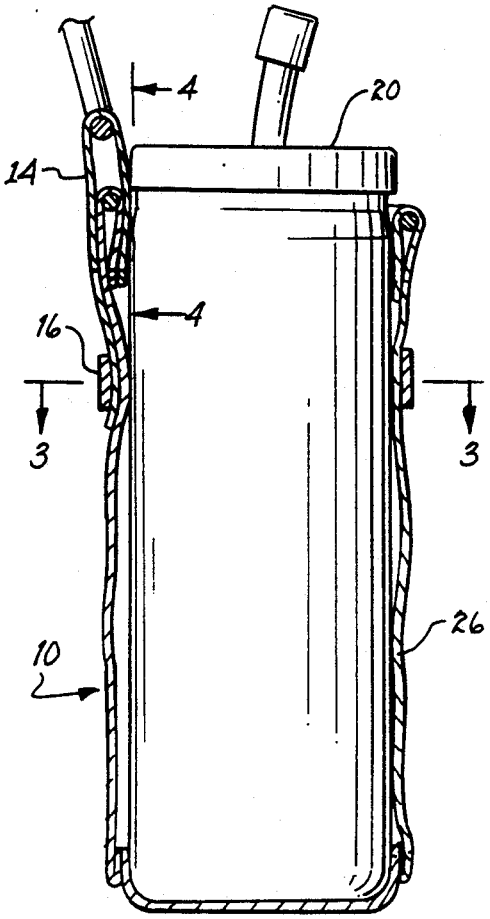
FIG. 2 is a cross-sectional view of the golf bag drink holder apparatus shown in FIG. 1.
Figure 3:
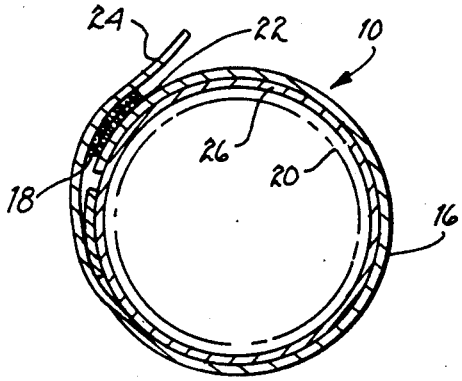
FIG. 3 is a cross-sectional view of the golf bag drink holder apparatus shown in FIG. 2 taken along the line 3—3.

Referring to FIG. 2, a golf bag drink holder apparatus or compartment means 10 is disclosed which holds a typical sports bottle 20, which typically has a lid and straw as shown. As shown in FIG. 1*a*, the drink holder apparatus 10 is connected to a golf bag 12 which typically contains the golf clubs used in playing golf. The drink holder apparatus 10 has one or more straps 14 made of a material or flexible material means such as fabric which allows the drink holder apparatus 10 to pivot in response to gravity to keep the sports bottle 20 within the drink holder apparatus 10 in a substantially upright position, thereby avoiding spillage. In addition, the drink holder apparatus 10 has a strap 16 used to secure the sports bottle 20 within the drink holder apparatus 10. FIG. 3 shows the strap means or strap 16 in detail. One end 22 of strap 16 is fixedly attached to the outer wall 26 of drink holder apparatus 10, while the other end 24 of strap 16 has attached to it one half of a hook-and-loop fastener 18 typically known as velcro which attaches the loose end 24 of strap 16 to the other half of hook-and-loop fastener 18, which is attached to the outer wall 26 of drink holder apparatus 10. In a typical application, the loose end 24 of strap 16 is unfastened from drink holder apparatus 10, a sports bottle 20 is placed in drink holder apparatus 10, and strap 16 is then tightened around sports bottle 20 and secured to drink holder apparatus 10 using fastener 18. The strap 16 therefore serves to hold the sports bottle 20 firmly within the drink holder apparatus 10.

Figure 1B:
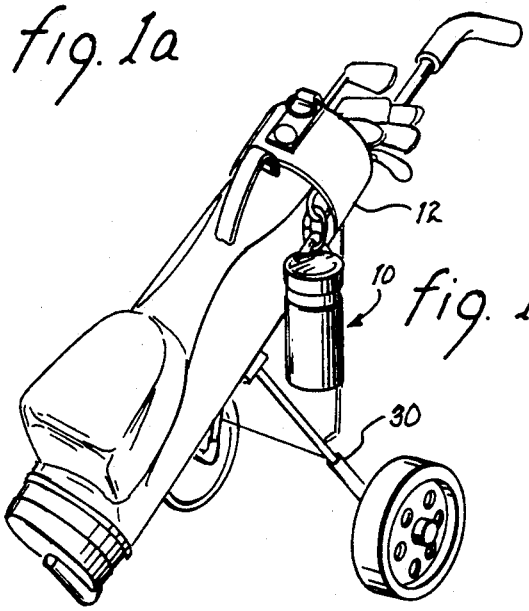
FIG. 1*b* is a perspective view of the golf bag drink holder apparatus of the present invention when used with a golf bag that is mounted to a wheeled cart, showing how the apparatus pivots in response to gravity to keep the enclosed sports bottle upright.

FIG. 1*a* illustrates how the drink holder apparatus 10 is connected to golf bag 12, which in this figure is equipped with a carrying strap 28 for carrying the golf bag 12. FIG. 1*b* shows the drink holder apparatus 10 when used with a qolf bag 12 that is mounted on a wheeled cart 30. This figure illustrates well how the connection means connection between drink holder apparatus 10 and golf bag 12 allows the drink holder apparatus 10 to pivot with gravity to keep the sports bottle 20 contained in drink holder apparatus 10 in a substantially upright position.

Figure 4:
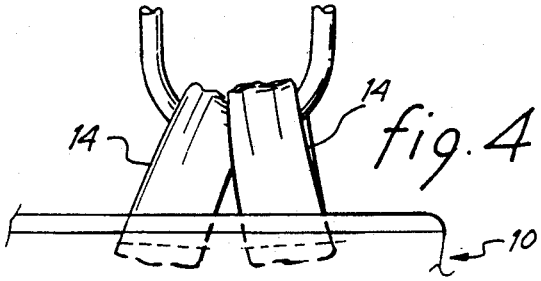
FIG. 4 is a partial perspective view of the straps which attach the golf bag drink holder apparatus of FIG. 1 to the golf bag.

FIG. 4 shows the preferred configuration of straps 14 being two straps at slight angles as shown to provide reliable mounting of the drink holder apparatus lo while allowing the required pivoting action.

While the invention has been described in its preferred embodiment, it is to be understood that the words which have been used are words of description rather than limitation, and that changes may be made within the purview of the appended claims without departing from the true scope and spirit of the invention in its broader aspects. For example, the mounting specifically illustrated shows the apparatus 10 coupled to a ring means or metal ring, which is attached to a metal loop on the golf bag. Any type of connection using a variety of materials is anticipated within the scope of this invention. In addition it is obvious that the apparatus of the present invention could be modified to accommodate drinks in cans, bottles, or boxes as well as those contained in sports bottles.

I claim:

1. A drink holder apparatus for golf bag comprising, in combination:

compartment means for holding a drink container;

connection means including ring means coupled to said compartment means for attaching said apparatus to said golf bag, said connection means comprising at least two loops of flexible material means connected to said ring means for allowing said apparatus to move in response to the force of gravity to keep said apparatus in a substantially upright position when said golf bag is tilted to a non-upright position; and strap means coupled to said compartment means for securing said drink container within said compartment means.

2. The apparatus of claim 1 wherein said drink container is a typical plastic sports bottle having a lid and straw.

3. The apparatus of claim 1 wherein said strap means comprises a strap having first and second ends, said first end being coupled to said compartment means, and having one half of a hook-and-loop type fastener coupled to said second end, said compartment means having the corresponding half of said hook-and-loop type fastener coupled thereto such that said strap can be tightened around said drink container and said second end of said strap can be attached to said compartment means using said hook-and-loop type fastener in a manner to hold said drink container within said compartment means.

* * * * *